United States Patent [19]

Kikuchi

[11] Patent Number: 4,974,025

[45] Date of Patent: Nov. 27, 1990

[54] METHOD OF CONTROLLING TONER CONCENTRATION IN ELECTROPHOTOGRAPHIC DEVELOPING APPARATUS

[75] Inventor: Susumu Kikuchi, Setagaya, Japan

[73] Assignee: Kyocera Corporation, Kyoto, Japan

[21] Appl. No.: 396,423

[22] Filed: Aug. 21, 1989

[30] Foreign Application Priority Data

Aug. 31, 1988 [JP] Japan ..... 63-214925

[51] Int. Cl.[5] ..... G03G 21/00

[52] U.S. Cl. ..... 355/246; 118/691

[58] Field of Search ..... 355/246; 118/691, 689, 118/688

[56] References Cited

U.S. PATENT DOCUMENTS 3,876,106 4/1975 Powell et al. ..... 355/246 X 4,119,989 10/1978 Carvalko et al. ..... 118/691 X 4,758,861 7/1988 Nakamaru et al. ..... 118/691 X

*Primary Examiner*—A. T. Grimley

*Assistant Examiner*—Sandra L. Hoffman

*Attorney, Agent, or Firm*—Spensley Horn Jubas & Lubitz

[57] ABSTRACT

The present invention provides a method of controlling toner concentration in a developing apparatus that uses a two-component developer consisting of a carrier and a toner, wherein the change in toner concentration in the developing container containing the developer is not taken out as it is to carry out the toner concentration control, but an approximately periodic waveform component is lapped over the detection signal to produce a waved detection output oscillated with the detection signal between the center, then the detection output and the control standard level corresponding to a prescribed toner concentration level are compared, and a level signal "Hi" and a level signal "Lo" plus a proportional pulse signal whose pulse width changes approximately proportionally between the level signals "Hi" and "Lo", that is, three types of signals are obtained from the comparison output, thereby making the toner supply operation different in conformity with the type of the signal.

10 Claims, 5 Drawing Sheets

METHOD OF CONTROLLING TONER CONCENTRATION IN ELECTROPHOTOGRAPHIC DEVELOPING APPARATUS

BACKGROUND OF THE INVENTION

1. Field of the Invention

The present invention relates to a method of controlling toner concentration in an electrophotographic developing apparatus, and more particularly to a method of controlling toner concentration in an electrophotographic developing apparatus that uses a two-component developer consisting of a carrier and a toner to allow the optimum mixing ratio of the carrier and the toner to be secured at all times.

2. Description of the Prior Art

Hitherto electrophotographic developing apparatuses that use a two-component developer consisting of a toner and a magnetic powder functioning as a carrier are known, and in such apparatuses, the image quality of the toner image (printed image) adhered to the latent electrostatic image on the photoconductor drum side is considerably influenced by the mixing ratio of the magnetic powder and the toner.

Further, in an electrophotographic developing apparatus using a two-component developer, even when the optimum mixing ratio is set originally, only the toner is consumed every time recording development is carried out (wherein the toner is stuck to the latent electrostatic image on the photoconductor drum), and the magnetic powder functioning as carrier remains in the developing container, so that the toner concentration in the developing container lowers, ultimately leading to an state incapable of development.

In order to obviate such a disadvantage, an apparatus for controlling toner concentration at a constant value is proposed that is based on the fact that toner concentration changes proportionally to the magnetic permeability, inductance, electric resistance, etc., and includes detecting means of detecting them in position in a developing container so that a prescribed amount of the toner is supplied suitably into the developer based on the detected output from said detecting means (Japanese Patent Publication No. 14896/1986).

However, in such an apparatus for controlling toner concentration, so-called overshoot, that is, excess supply of the toner occurs due to the delay of response of the detecting means, so that it becomes difficult to control the toner concentration in the optimum manner. Further, as the apparatus is made smaller as in recent years, the toner supply rate becomes high relatively to the volume of the developer in the developing container, so that in practice the above disadvantage has become too conspicuous to be ignored.

In order to obviate the disadvantage, a control apparatus is developed wherein the detecting operation of said detecting means and the supplying operation are separated, and every time the lowering of the toner concentration to or below a certain level is detected by said detecting means, a prescribed amount of the toner is supplied batch-wise. In this apparatus, unrequired overshoot due to the delay of the response of the detecting means can be obviated, but accurate control cannot be effected because the control is so-called zone control wherein every time the toner concentration lowers to a certain level, a prescribed amount of the toner is supplied.

The toner concentration of the developer tends to fluctuate due, for example, to the stirring action by a stirring member and the timing of the start of the developing operation, and since any of the above prior techniques grasps the toner concentration not as an average value within a certain period but as a momentary value, in some cases, the detecting means judges erroneously the toner concentration to be a control standard level or below even in the event that the toner concentration is normal, and as a result the toner is supplied by the wrong control, resulting in an excess toner concentration.

To obviate such a disadvantage, a technique capable of correcting the fluctuation of the output of a detecting means immediately after the start of the operation of a developing section is proposed wherein a correction signal corresponding to the difference between the output signals of the detecting means at the time when the operation of the developing section is stopped and at the time when the operation is resumed is produced, the thus produced correction signal is added to the output signals of the detecting means at the time when the operation of the developing section is started and at the time when the next operation is started thereby carrying out the correction, and the correction signal is attenuated by a predetermined time constant (Japanese Patent Laid-Open (Kokai) No. 24641/1979).

Although the prior technique can deal with the fluctuation of toner concentration due to the timing of the start of the operation of the development, it cannot deal with the fluctuation of toner concentration due to the stirring operation during the developing operation.

In order to prevent a detection error due to the momentary grasp of the toner concentration, a technique is disclosed wherein a concentration detecting circuit that compares the detection signal (voltage) of the toner concentration with a standard concentration level (voltage) for example as shown in FIG. 5 to produce a level signal "Hi" when the detection signal of the toner concentration is at or below the standard concentration level, and a level signal "Lo" when the detection signal of the toner concentration is at or above the standard concentration level, a pulse initiator for producing a clock pulse signal Ck corresponding to a prescribed standard clock, and an AND circuit that takes "AND" of said clock pulse signal Ck and the level signal "Hi" to produce its logical product signal Rs are includes, a toner supply signal Ts1 is produced synchronously with said logical product signal Rs to effect a prescribed supply operation, when said logical product signal Rs has reached a prescribed number of counts or over, in other words, when the prescribed number of the toner supplies has recurred, that is automatically detected thereby thinning said logical product signals Rs and switching to time supply that will produce a toner supply signal Ts2 at every prescribed interval, and after said time supply is effected for a prescribed period, said toner supply signal Ts1 is produced again to repeat the above operation (Japanese Patent Publication No. 42873/1981).

In this prior technique, when the toner supply is repeated prescribed times, since the technique uses such a toner supply operation that the logical product pulse is changed to the thinned pulse (time supply), excessive supply of the toner can be prevented, but if development that consumes a large amount of the toner as in solid black development is effected, toner supply cannot follow quickly the consumption, as a result the image quality becomes thin disadvantageously, and since the technique uses pulse (intermittent) supply control based on the logical product signal Rs, if the toner concentration has decreased sharply, it is quite difficult to recover the toner concentration quickly.

SUMMARY OF THE INVENTION

The present invention takes the above disadvantages of the prior art into consideration, and thus an object of the present invention is to provide a method of controlling toner concentration wherein the supply of the toner can be adjusted to increase or decrease proportionally to the difference between the existing toner concentration level and the optimum toner concentration level so that even if the apparatus is made smaller and the toner supply speed is increased relatively, toner concentration can be controlled accurately without causing overshoot.

Another object of the present invention is to provide a method of controlling toner concentration wherein even if the toner concentration has fluctuated, the average amount of the toner can be detected accurately, so that if the toner concentration fluctuates due to the stirring operation of a stirring member and the timing of the start of the operation of the development, the fluctuations are absorbed thereby allowing the toner concentration to be controlled accurately.

Still another object of the present invention is to provide a method of supplying a toner wherein although the toner concentration is not grasped momentarily but grasped as an average for a certain time interval, the restoration of the toner concentration to the standard level can be quickly effected without causing overshoot or undershoot even in the case of excessive consumption or too little consumption of the toner.

Other objects of the present invention will become apparent from the description of the present invention and the following embodiments.

To attain the above objects, the first feature of the present invention is resides in that the detection signal of the toner concentration in a developing container is not taken out as it is but an approximately periodic waveform component is lapped over the detection signal so that a detection output waved to opposite sides with said detection signal being center may be produced.

Said waved detection output can be electrically or mechanically produced, and for example if the waved detection output is to be electrically produced, an electrically oscillated waveform component such an alternate current component, direct current component, or alternating pulse component is lapped over the detection signal corresponding to the change in the toner concentration as shown in FIG. 2, or if the waved detection output is to be mechanically produced, for example, stirring energy or oscillating energy is applied to the dwelled toner opposed to a toner concentration sensor including a magnetic permeability measuring sensor, etc. as shown in FIG. 4 that will be described later, so that the oscillated waveform component can be mechanically produced.

Although there is no particular limit on the waved detection output if the waved detection output is a waveform component that is oscillated to opposite sides with the detection signal being the center, when an oscillated waveform component, an alternate current waveform component, a triangular waveform component, or a saw tooth waveform component is used, a proportional pulse signal (described later) having a conducting pulse width proportional to the difference between the standard level and the toner concentration change can be preferably obtained.

The second feature of the present invention resides in that the detection output and the control standard level corresponding to a prescribed toner concentration level are compared, and based on the signal state of the comparison output the control of the toner concentration is carried out, more specifically a level signal "Hi" and a level signal "Lo" plus a proportional pulse signal whose pulse width changes approximately proportionally between the level signals "Hi" and "Lo", that is, three types of signals (which will be described later) are obtained from the comparison output, thereby making the toner supply operation different in conformity with the type of the signal.

It is preferable that the supply operation is carried out in such a manner that, for example, a toner supply motor is rotated at the maximum speed when the signal is the level signal "Hi", while the toner supply motor is stopped when the signal is the level signal "Lo", and the rotational frequency of the supply motor is controlled in accordance with the pulse width when the signal is the proportional pulse signal.

Now, the operation and the effect of the present invention will be described with reference to FIG. 1.

First, when a detection signal A corresponding to a toner concentration change in the developing container is obtained by using a known detecting means, and an oscillated waveform component oscillated periodically in a prescribed periodic manner with the curve A being the center is lapped over the signal curve A, a detection waveform curve indicated at B can be obtained.

When the detection output corresponding to the detection waveform curve B and the control standard voltage level CL corresponding to the optimum standard toner concentration are compared by a comparator, the comparison output will be the level signal "Lo", the level signal "Hi", or the pulse signal (hereinafter referred to as proportional pulse signal).

That is, if the bottom value of the detection waveform curve B is not less than the standard voltage level CL, the signal will be the level signal "Lo", while if the peak value of the detection waveform curve B is not more than the standard voltage level CL, the signal will be the level signal "Hi", and therefore in the case of the level signal "Lo", the toner supply operation is stopped, while in the case of the level signal "Hi", the toner supply operation will be resumed, so that an effect is obtained as if an upper standard level and a lower standard level were arranged respectively on the opposite sides of the center standard level.

The present invention includes the above operation, further if the standard voltage level CL is between the bottom value and the peak value (the peak of the detection waveform curve B is designated as pb) of the detection waveform curve B, since a proportional pulse signal having a conducting pulse width proportional to the position of the standard voltage level CL can be obtained, the pulse signal is effectively used, and the toner supply is controlled for example by changing continuously the supply of the toner proportionally to the pulse width in the pulse region, that is, the supply of the toner can be adjusted proportionally to the difference between the existing toner concentration level and the optimum toner concentration level.

The effect of the present invention will now be described.

Therefore, according to the present invention, by combining effectively the peak pb of the detection waveform curve B with the standard voltage level CL, an effect is obtained as if the upper limit standard level [CL+p] and the lower limit standard level [CL−p] are arranged respectively on the opposite sides of the center standard level CL, so that zone control becomes possible effectively without providing a plurality of control standard levels, as a result the constitution of the circuit can be made simple, and the control operation is not made complicated since the control is based on one comparison output.

Further, not only the present invention includes simple zone control, but in the present invention, after the transfer to the zone, since the supply of the toner can be adjusted proportionally to the difference between the existing toner concentration level and the optimum toner concentration level CL on the basis of said proportional pulse signal, control of accurate toner concentration can be effected without having overshoot and undershoot outside the zone.

As a result, according to the present invention, when the apparatus is made smaller, and the supply speed of the toner is made high relatively to the volume of the developer, the optimum control of the toner concentration is made easy all the time.

Further, according to the present invention, to judge whether the comparison output is the level signal "Hi", the level signal "Lo", or the proportional pulse signal, it is required to detect the state of the signal of the comparison output at a time interval at least not less than one period of the oscillated waveform component, and this means that if the toner concentration changes due to the stirring operation of the stirring member, and the timing of the start of the operation of the development, or the toner concentration changes, for example, due to noises, the average toner amount can be accurately detected thereby preventing so-called erroneous judgment positively.

Thus, according to the present invention, various effects can be exhibited.

BRIEF DESCRIPTION OF THE DRAWINGS

FIG. 1 is a chart showing the relationship between the toner concentration and the detection waveform curve, etc.; FIG. 2 is a schematic view of an apparatus for producing electrically a waveform component; FIG. 3 is a schematic view of an apparatus for producing mechanically a waveform component; FIG. 4 is an enlarged view of the essential part of the apparatus shown in FIG. 3; and FIG. 5 is a time chart showing the toner supply operation of the prior art that is illustrated for the comparison to the embodiment of the present invention.

DETAILED DESCRIPTION OF THE PREFERRED EMBODIMENTS

Now, the preferred embodiments of the present invention is described in detail with reference to the drawings. Unless otherwise specified, the size, material, and shape of the constitutional parts involved in the embodiment, and the relative arrangement of the constitutional parts do not mean to restrict the scope of the present invention, and are given for illustrative purpose only.

Figure 2:
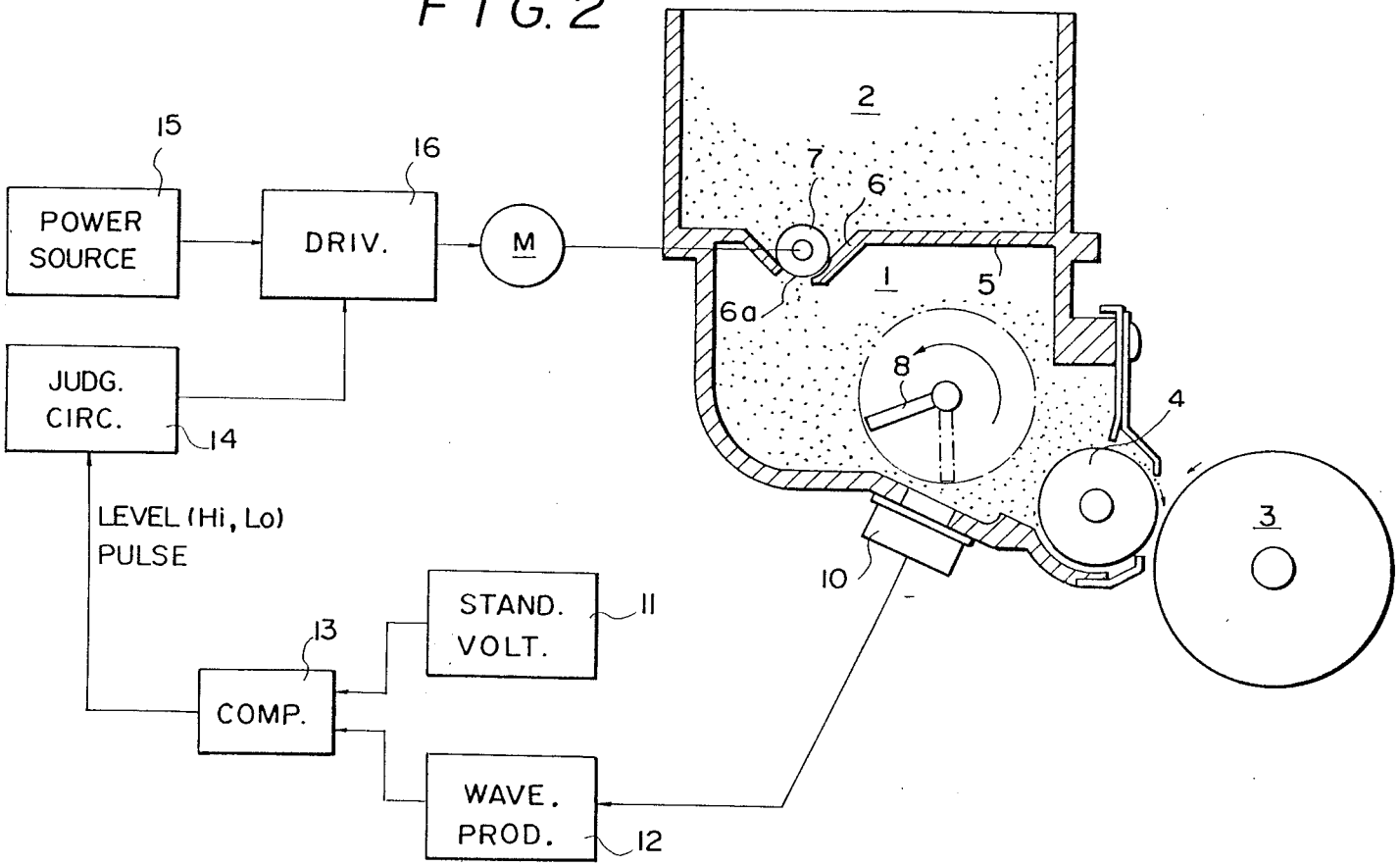

FIG. 2 shows the internal constitution of the developing apparatus used in the embodiment of the present invention, and the mechanical constitution is described briefly as follows: 1 indicates a developing container containing a carrier and a toner in a prescribed concentration ratio, a sleeve 4 containing a magnetic roll (fixed magnet assembly) (not shown) is rotatably attached on the open side thereof opposed to a photoconductor drum 3, and a toner container 2 is attached on the developing container 1 with a partition plate 5 between them.

The bottom of a tapered guide recess 6 formed in an arbitrary part of the partition plate 5 is formed with a slit opening 6*a*, a toner supply roller 7 covered with sponge is rotatably attached to the opening 6*a*, and a DC motor M connected to the roller 7 is rotated and controlled to allow the supply of the toner to be adjusted arbitrarily.

The developing container has a rotatable stirring member 8 approximately in the central part thereof so that the toner supplied through the toner supply roller 7 into the developing container may be stirred together with a carrier, and a toner concentration sensor 10 is attached to the undersurface of the container below the stirring member 8 so that the rotation control including driving and stopping of the DC motor, that is, the toner supply control may be carried out based on the detection signal from the sensor 10.

Now, the constitution of the circuit for carrying out the toner supply control will be described. Reference numeral 11 indicates a standard voltage generator for generating a standard voltage corresponding to the optimum toner concentration level, 12 indicates a waveform producing means for lapping, for example, an alternately oscillating waveform component over the detection signal from the toner concentration sensor 10, 13 indicates a comparator for comparing the output voltages from the standard voltage generator 11 and the waveform producing means 12 to output a comparison signal, that is, one of the level signal "Hi", the level signal "Lo", and the proportional pulse signal, 14 indicates a judging circuit for judging whether the comparison output is the level signal "Hi", the level signal "Lo", or the proportional pulse signal by detecting the state of the signal of the comparison output in a time interval not less than one period interval of the alternating waveform, 15 indicates a standard power source for driving the DC motor M, and 16 indicates a motor driving/controlling circuit for carrying out the voltage control (pulse width voltage adjustment) based on the pulse width of the proportional pulse signal and the ON/OFF control of the standard power source 15. Thus, when the level signal "Hi" is inputted to the motor driving/controlling circuit 16, the motor M is rotated with the electric current passed fully, or when the level signal "Lo" is inputted, the motor M is stopped, or when the pulse signal is inputted, a voltage proportional to the width of the passage of the current is supplied to the motor M to carry out the rotation control, that is, the so-called proportional rotation control can be carried out.

The control operation of the embodiment will now be described briefly with reference to FIG. 1. First, when a printing operation command is issued, the standard voltage CL corresponding to the optimum toner concentration level outputted from the standard voltage generator 11 is compared with the detection waveform curve B formed by lapping the alternatively oscillating waveform component over the detection signal from the toner concentration sensor 10 by the waveform producing means 12, and a comparison output, that is, one of the level signal "Hi", the level signal "Lo", or the proportional signal is obtained from the comparator 13.

The judging circuit 14 judges which type of signal it is, and for example if the comparison output is the level signal "Hi" indicating that the peak value of the detection waveform curve B is not more than the standard voltage level CL, printing operation is not carried out, and the following toner supply operation is carried out.

That is, if the comparison output is the level signal "Hi", a voltage level corresponding to the standard power source 15 for driving the motor is outputted from the motor driving/controlling circuit 16 to the motor M to rotate the toner supply roller 7 at the maximum rotational speed thereby supplying the toner into the developing container 1.

Since the toner supplied into the developing container 1 by the supply operation is stirred to be mixed uniformly by the stirring member 8, the toner concentration increases like a linear function, as a result the detection waveform curve B is transferred to the pulse region quickly, and correspondingly the signal outputted from the comparator 13 is changed to the proportional pulse signal having a conducting pulse width proportional to the difference between the standard voltage level CL and the existing toner concentration level.

After the transfer of the detection waveform curve B into the pulse region, the printing operation is resumed, and a voltage corresponding to the conducting pulse width is supplied from the motor driving/controlling circuit 16 toward the motor M to carry out the rotation control to transfer the toner concentration to the optimum toner standard concentration level CL, while the toner in the developing container 1 is supplied through the sleeve 4 toward the photoconductor drum 3 to carry out the prescribed developing operation.

On the other hand, when the toner in the developing container is consumed successively by the repeated developing operations, the toner concentration sensor 10 detects the consumption as a decrease of the toner concentration, and the detection waveform curve B lowers correspondingly.

Thus when the detection waveform curve B lowers, the conducting pulse width of the pulse signal changes to increase accordingly, thereby a voltage proportional to the conducting width is supplied to the motor M from the motor driving/controlling circuit 16 to carry out the rotation control, the toner in an amount corresponding to the toner consumption is supplied, and as a result the toner concentration control can be carried out with the optimum toner concentration level kept.

If a sudden decrease in the toner consumption and the delay of the detection or the like are overlapped thereby allowing the bottom value of the detection waveform curve B to be not less than the standard voltage level CL, the pulse signal changes to the continuous level signal "Lo", and at the same time the rotation of the motor M is stopped until the proportional pulse signal is outputted again, that is, the toner supply operation is stopped.

Figure 1:
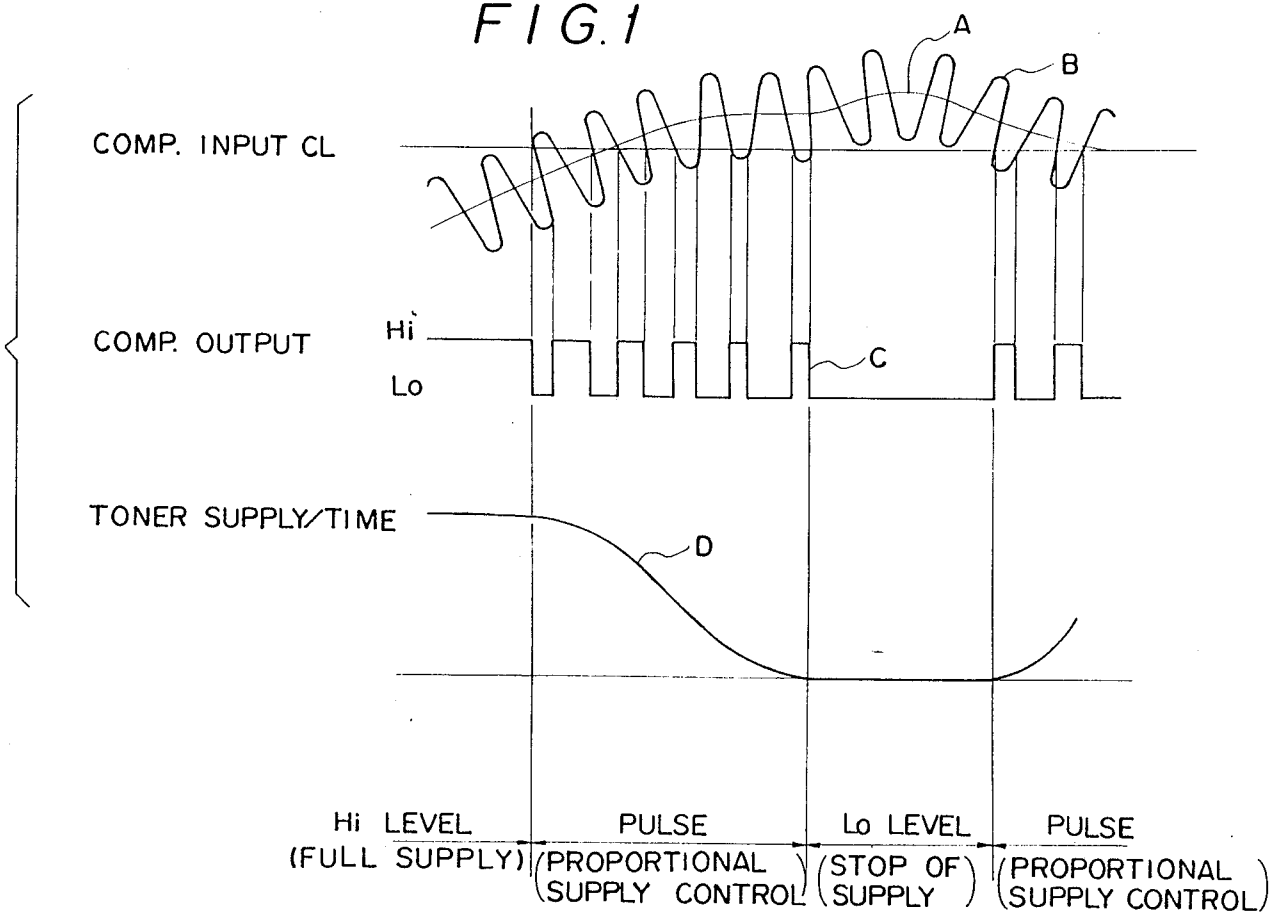
FIGS. 1 to 5 show developing apparatuses used in the embodiments of the present invention.

FIG. 1 shows, in the order from the top to the bottom, the standard voltage level CL to be inputted to the comparator and the overlapped detection waveform curve B formed by overlapping the detection signal A from the toner concentration sensor 10 and the alternately oscillating waveform component, the comparison output C from the comparator, the toner supply D per unit time corresponding to the rotational frequency change curve of the motor M based on the comparison output, and the type of the supply operation.

Figure 3:
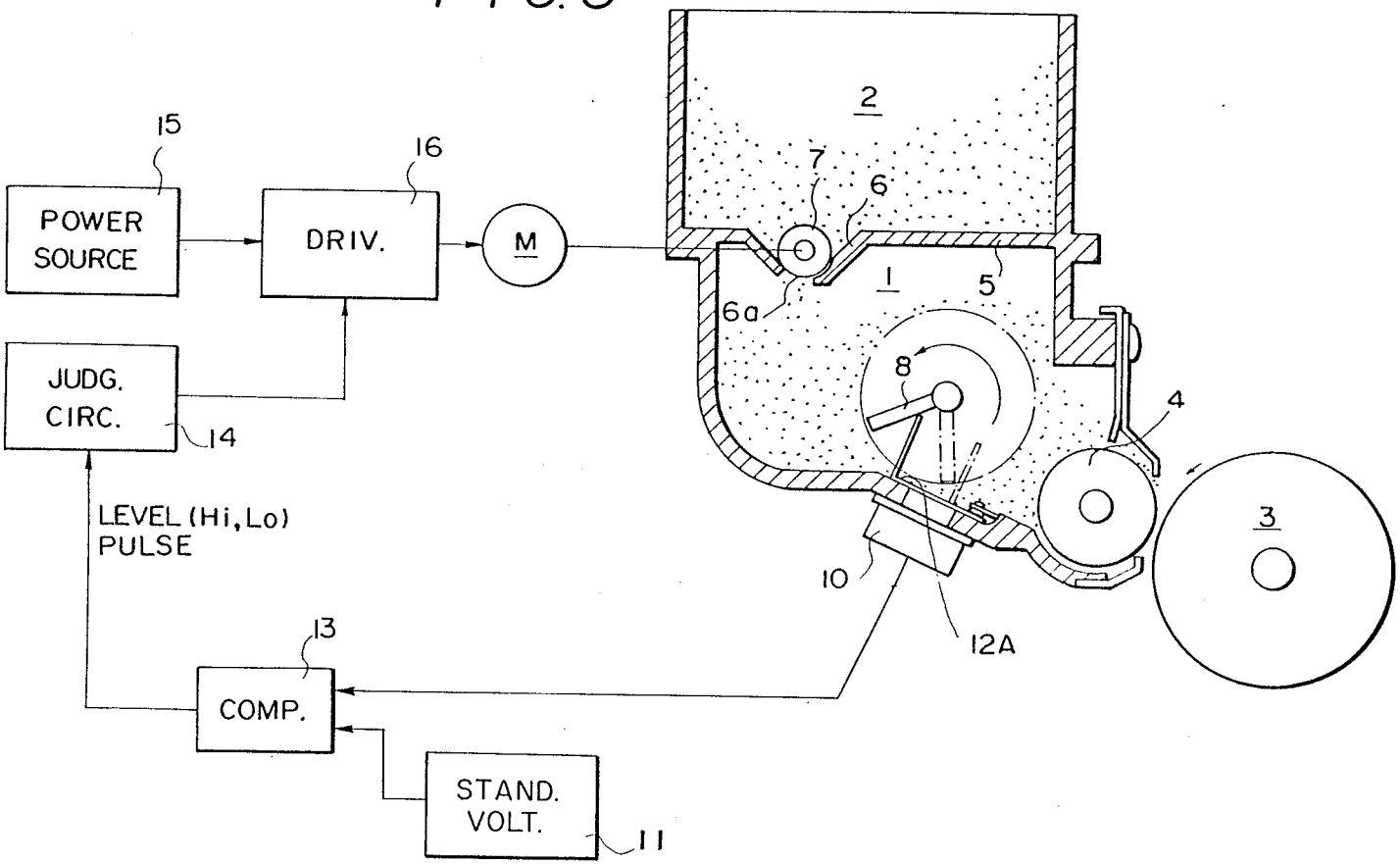
Figure 4:
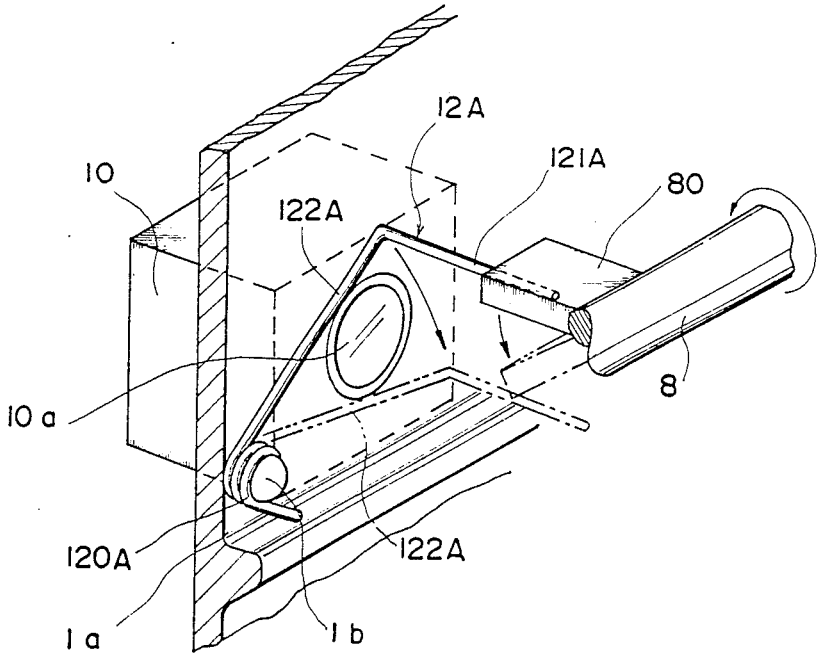
Figure 5:
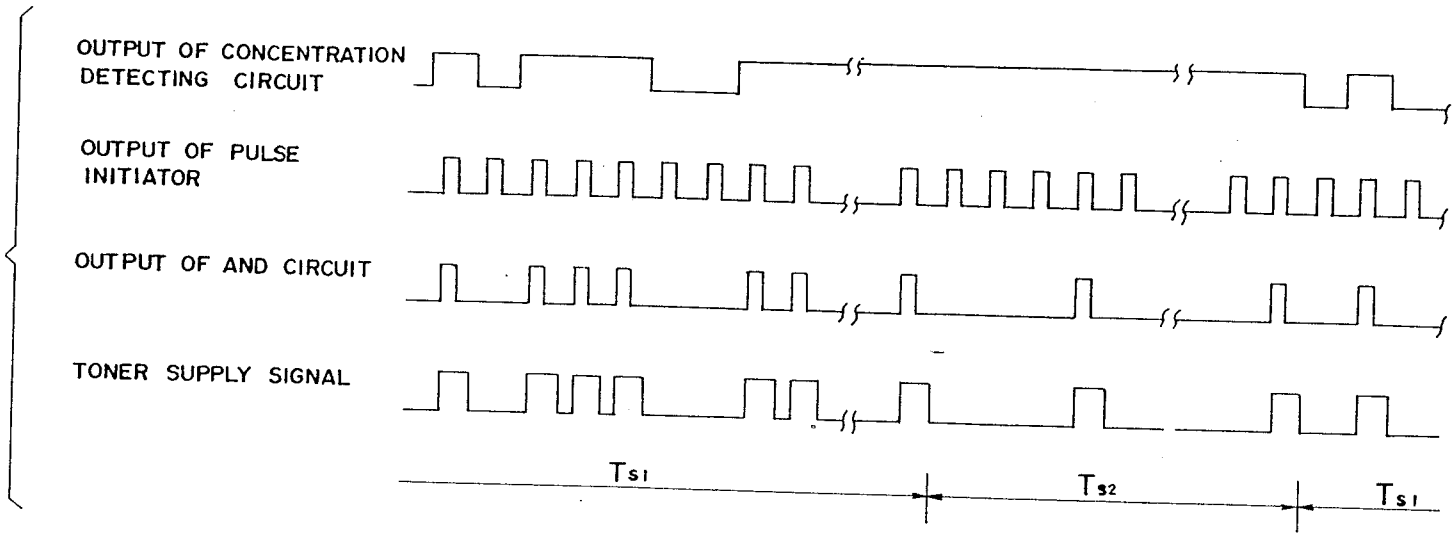
FIG. 5 (PRIOR ART)

FIGS. 3 and 4 shows another embodiment wherein the waveform producing means 12 is formed mechanically, a section 122A of an approximately L-shaped spring member 12A made of a piano wire is allowed to slide on the surface of a front window section **10*a* of the toner consentration sensor approximately flush with a bottom wall 1*a* of the container as shown in FIG. 4, a spring member base 120A is pivotally supported on a pivot 1*b* of the container bottom wall 1*a*, and its free end side 121A is extended upward engageably with a rotating blade 80 of the stirring member 8. By the rotation of the stirring member 8, the spring member 12A is slid on the surface of the front window section 10*a* of the sensor 10 until it is swung through a prescribed angle, then the spring member 12A is disengaged from the rotating blade 80, so that the spring member 12A returns to the original position due to its own resiliency while the spring member 12A slides on the surface of the front window section 10*a* of the sensor 10**.

As a result, the detection output from the toner concentration sensor 10 itself has an oscillated waveform, and since the waveform is formed periodically to follow the rotational speed of the rotating blade 80, the oscillated waveform can have an effect equivalent to the alternating component, and this embodiment can have similar action and effect to those of the first embodiment, except that the detection output itself from the toner concentration sensor 10 has an oscillated waveform.

What is claimed is:

1. A method of controlling toner concentration in a developing apparatus that uses a two-component developer comprising a carrier and a toner, wherein a detection output formed by superimposing an approximately periodic waveform component on a detection signal indicative of the toner concentration in a developing container containing said developer is compared with a control standard level corresponding to a predetermined toner concentration level, and based on the state of the signal of the obtained comparison output, the toner concentration control is carried out.

2. A method of controlling toner concentration as claimed in claim 1, wherein the state of the signal of the comparison output at a time interval not less than one periodic interval of said waveform component is detected to judge whether the comparison output is the level signal "Hi", the level signal "Lo", or the pulse signal, and the toner supply operation is made different in conformity with the type of the judged signal.

3. A method of controlling toner concentration as claimed in claim 1, wherein the detection output is a detection output formed by lapping a waveform component oscillated in a prescribed periodic manner over the change in toner concentration in the developing container.

4. A method of controlling toner concentration as claimed in claim 1, wherein said waveform component is an oscillated waveform component, an alternating current waveform component, a triangular waveform component, or a saw tooth waveform component.

5. A method of controlling toner concentration as claimed in claim 1, wherein said waveform component is an oscillated waveform component formed by applying stirring energy, oscillating energy or the like to the dwelled towner located opposite to a toner concentration sensor.

6. A method of controlling toner concentration as claimed in claim 2, wherein the pulse signal as said comparison output is a proportional pulse signal having a conducting pulse width proportional to the difference between the standard level and the toner concentration change, and toner supply control proportional to the conducting pulse width of the pulse signal is carried out.

7. A method of controlling toner concentration as claimed in claim 1, wherein said toner concentration control comprises the steps of supplying toner at a first rate when a bottom peak value of said detection output is higher than said control standard level, supplying toner at a second rate when a top peak value of said detection output is lower than said control standard level, and supplying toner at an intermediate rate which is between said first rate and said second rate when the top peak value of said detection output is higher than said control standard level and the bottom peak value of said control standard level is lower than said control standard level.

8. A method for controlling toner concentration in a developing container that contains a two-component developer comprising a carrier and a toner, said method comprising the steps of:

modulating a detection signal indicative of the toner concentration in the developing container with a periodic signal;

comparing the modulated detection signal to a predetermined reference; and supplying toner to the container in accordance with said comparison.

9. A controller for controlling toner concentration in a developing container that contains a two-component developer comprising a carrier and a toner, said controller comprising:

detection means for providing a detection signal indicative of the toner concentration in the developing container;

modulating means for modulating the detection signal with a periodic signal;

comparison means for comparing the modulated detection signal to a predetermined reference; and supply means for supplying toner to the container in accordance with said comparison.

10. The controller of claim 9 wherein the developing container has stirring means for stirring the developer in the container, and the stirring means comprises a rotating member, said detection means comprising a sensor having an input and said modulating means comprising a member positioned in front of the sensor input and coupled to the rotating member so as to be actuated by said rotating member to have a periodic motion in front of the sensor input.

* * * * *